US009498071B2

(12) United States Patent
Mossman

(10) Patent No.: US 9,498,071 B2
(45) Date of Patent: Nov. 22, 2016

(54) HARNESS SYSTEM FOR A BABY CARRIER

(71) Applicant: Ralph Mossman, San Antonio, TX (US)

(72) Inventor: Ralph Mossman, San Antonio, TX (US)

( * ) Notice: Subject to any disclaimer, the term of this patent is extended or adjusted under 35 U.S.C. 154(b) by 85 days.

(21) Appl. No.: 14/669,477

(22) Filed: Mar. 26, 2015

(65) Prior Publication Data

US 2016/0278536 A1 Sep. 29, 2016

(51) Int. Cl.

*A47D 13/02* (2006.01)
*A45F 3/14* (2006.01)
*A45F 3/12* (2006.01)

(52) U.S. Cl.

CPC ..... *A47D 13/02* (2013.01); *A45F 3/12* (2013.01); *A45F 2003/142* (2013.01)

(58) Field of Classification Search

CPC ..... A47D 13/02; A47D 13/025; A45F 3/12; A45F 3/14; A45F 2003/142
USPC ..... 224/257, 258, 158, 159, 160, 161, 162, 224/264, 625
See application file for complete search history.

(56) References Cited

U.S. PATENT DOCUMENTS 730,325 A 6/1903 Wilson et al.
2,804,249 A * 8/1957 Manalo ..... A47D 13/02 224/158
4,667,624 A * 5/1987 Smith ..... A01K 27/00 119/770
D298,386 S * 11/1988 Hirahara ..... 224/264
4,903,873 A * 2/1990 Poole ..... A41D 7/00 224/158
5,064,108 A * 11/1991 Headley ..... A45F 3/14 224/259
5,267,680 A * 12/1993 Torok ..... A47D 13/02 224/158
5,540,365 A * 7/1996 LaMair ..... A47D 13/02 224/158
D375,184 S * 11/1996 Hickli ..... D3/213
5,669,170 A * 9/1997 Norris ..... F41C 33/00 224/150
5,762,242 A * 6/1998 Yost ..... A63C 11/025 224/250
5,806,087 A * 9/1998 Grotefend ..... A41F 9/005 2/1
5,873,133 A * 2/1999 Jurga ..... A41F 9/002 2/322
5,893,503 A 4/1999 Jean
5,915,606 A * 6/1999 Jensen ..... A45F 3/14 224/148.6
6,006,970 A * 12/1999 Piatt ..... A45F 3/14 224/257
6,213,362 B1 * 4/2001 Lorenzini ..... A47D 13/02 224/158
6,378,746 B1 4/2002 Miller
6,378,937 B1 * 4/2002 Faudman ..... A47D 15/00 297/183.1
6,467,661 B1 * 10/2002 Mistretta ..... A45F 3/12 2/268
6,626,489 B2 * 9/2003 Geis ..... A47D 13/025 224/160

(Continued)

FOREIGN PATENT DOCUMENTS

DE EP 1774875 A1 * 4/2007 ..... A45F 3/14
GB 2465844 A * 6/2010 ..... A45F 3/14
LI EP 1714590 A1 * 10/2006 ..... A45F 3/047

*Primary Examiner* — Justin Larson
(74) *Attorney, Agent, or Firm* — Miguel Villarreal, Jr.; Gunn, Lee & Cave, P.C.

(57) ABSTRACT

A harness system comprised of a harness assembly having adjustable shoulder and waist straps connected therewith secured at two points of engagement to an anchoring assembly permanently anchored to a baby carrier. A padding member is attached to the shoulder strap of the harness assembly extending over either side of the user's shoulder. The adjustability of the present invention provides a system that accommodates users of various sizes. The anchoring assembly is comprised of a plurality of washers, a plurality of anchoring straps, and at least one spacer secured to a carrier bar of the carrier by a fastener and a lock nut. Two anchoring straps on each side of the carrier allow the harness assembly to be releasably anchored to either side of the anchoring assembly depending upon the user's preference. Once the harness assembly is connected to the carrier, the user may carry the carrier "hands-free."

1 Claim, 4 Drawing Sheets

(56) References Cited

U.S. PATENT DOCUMENTS 6,926,181 B1 8/2005 Vath
7,125,071 B2 * 10/2006 Aiudi ..... A47D 13/02 224/158
7,165,706 B2 * 1/2007 Barr ..... A45C 7/009 224/661
D578,751 S * 10/2008 Holtzclaw, Jr. ..... D3/224
D588,802 S * 3/2009 Cicione ..... D3/228
7,575,136 B2 * 8/2009 Kernkamp ..... A45F 3/14 224/158
7,810,682 B2 * 10/2010 Balensiefer ..... A47D 13/02 224/158
7,841,653 B2 * 11/2010 Sanchez ..... B60N 2/2845 24/3.12
7,909,214 B2 3/2011 Gold et al.
8,464,919 B1 6/2013 Goozdich
8,851,342 B2 * 10/2014 Carbone ..... A47D 13/02 224/158
9,144,322 B2 * 9/2015 Gillam ..... A47D 13/02
2006/0208541 A1 9/2006 Sanchez
2006/0249997 A1 * 11/2006 Sanchez ..... A47D 13/02 297/183.1
2006/0261105 A1 * 11/2006 Balensiefer ..... A47D 13/02 224/159
2006/0273128 A1 * 12/2006 Balakier ..... A45F 3/14 224/578
2007/0080184 A1 * 4/2007 Cowen ..... A45F 3/14 224/160
2007/0246493 A1 * 10/2007 Kernkamp ..... A45F 3/14 224/159
2008/0006668 A1 1/2008 Nowacki et al.
2008/0190980 A1 * 8/2008 Overton ..... A45F 3/14 224/664
2008/0217368 A1 * 9/2008 Denton ..... A47D 13/02 224/159
2008/0245830 A1 10/2008 Pseiffer
2012/0000947 A1 1/2012 Ashely
2015/0069105 A1 * 3/2015 Pollock ..... A45F 3/14 224/625
2015/0150363 A1 * 6/2015 Cavolt ..... A45F 5/021 224/666
2016/0157632 A1 * 6/2016 Nemerouf ..... A47D 13/025 224/159

* cited by examiner

HARNESS SYSTEM FOR A BABY CARRIER

CROSS REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

This invention is related to harnesses, and more particularly to a harness system for carrying a baby carrier.

2. Description of the Related Art

In general, when a parent moves their infant child from one location to another, the parent usually carries the infant in a baby carrier. The infant typically weighs approximately 6 to 20 lbs. during the time it remains in the carrier. As the infant grows, it gets heavier. Consequently, the weight of the infant plus the weight of the carrier over time becomes very cumbersome for the parent.

As the parent's arm becomes fatigued due to the weight of the carrier, the parent attempts to compensate by raising the shoulder on the side of the carrier to maintain the carrier—further applying more stress and discomfort on the neck, shoulders and back—or by switching arms used to carry the carrier. As the weight of the carrier and child is unevenly distributed, the parent may lose his or her balance as a result of either action taken and fall, thereby sustaining injury. As the parent falls, it is likely the parent may lose grip of the carrier resulting in the carrier and child being dropped causing injury to the child.

There exist in the art several different kinds of carrying devices. However, those used in connection with baby carriers actually loop around the carrier bar of the carrier rather than permanently anchor to a fixed location. These carrying devices tend to freely slide along the length of the carrier bar during use by the parent or user. Such uncontrolled and sporadic locomotion of the strap on the carrier bar poses a hazard to the user. The strap may unexpectedly slide hard against the user's hand with sufficient force to disengage the hand (holding the carrier bar) from the carrier bar resulting in the carrier being flipped over or dropped and causing injury to the child. Further, if the strap on the carrier slides away from the user (e.g., the portion of the carrier bar farthest away from the user) and the user attempts to pull the strap back to the original location, rather than sliding back, the strap may pull on the opposite side of the carrier causing the carrier to flip toward the user and harm or injure the user, the user's hand and/or possibly even the child.

There is a need for a sturdy, robust, light-weight, and easy-to-use harness system that includes a harness assembly with adjustable shoulder and waist straps to evenly distribute the weight of a baby carrier and child across the user's body. There is also a need for a harness system having an anchoring assembly that fastens directly to and is permanent anchored at a single fixed location, e.g., on the carrier bar of a baby carrier, and which provides dual engagement points for the attachment of the harness assembly to prevent the carrier from tipping over or being dropped and thereby increase the safety of the child and the user.

BRIEF SUMMARY OF THE INVENTION

The present invention is a harness system used in connection with a baby carrier. The present invention is comprised of a harness assembly having adjustable shoulder and waist straps connected therewith and secured to an anchoring assembly permanently anchored to a baby carrier. The present invention removably attaches to the baby carrier at two points of engagement allowing the carrier to be at a stable position on either side of the parent or user while transporting the infant (and later, the child). The height at which the carrier is carried by the parent or user is optimized for securing the carrier so that it does not flip over. The optimized height also allows for maximum movement of the user's arm on the same side as the carrier.

Through the use of adjustable straps for the shoulder and waist, the present invention provides for a configuration where the weight of the carrier and child being carried is distributed and maintained evenly over the user's upper torso, across the larger muscles of the chest and shoulders. This configuration reduces fatigue, alleviates back discomfort or even pain, and reduces or removes excess stress to the body due to carrying a carrier, as compared to such stress (i.e., back pain) becoming greater the larger the child becomes due to the prolonged carrying of a carrier (and child) without the use of the present invention.

The present invention prevents the user from accidentally dropping the carrier due to weight or by accidental bumping of another object or person (e.g., as in a crowd) while still maintaining all of the original safety features of the carrier (i.e., carrier bar) in the unlikely event that the user trips and falls while using the present invention to carry the carrier. The present invention also allows the parent or user to be "hands-free" permitting the parent or user to do other activities.

DETAILED DESCRIPTION OF THE INVENTION

Figure 1:
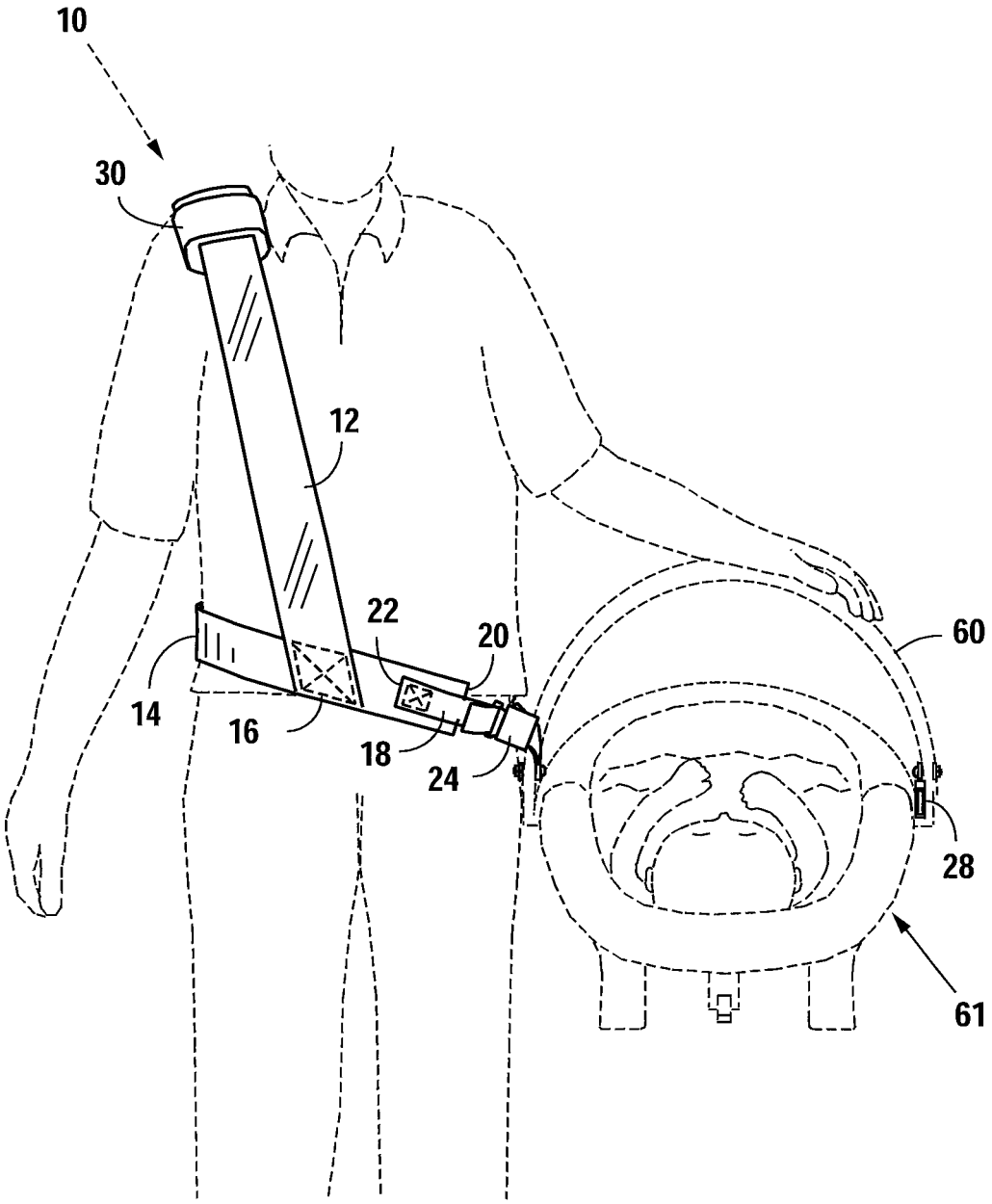
FIG. 1 is a front environmental view of the present invention in use.

FIG. 1 illustrates the present invention in use by a user to carry a baby carrier. Harness assembly 10 is comprised of shoulder strap 12 and waist strap 14. Shoulder strap 12 goes over the user's shoulder. Waist strap 14 goes around the user's waist. Shoulder strap 12 and waist strap 14 are attached together through stitching 16 both in front of the user, as shown in FIG. 1, as well as behind the user (not shown). Padding member 30 is attached to shoulder strap 12 of harness assembly 10. Padding member 30 extends over the shoulder of the user such that a portion of padding member 30 is on the back as well as the front of the user. Strap 18 is attached at one end near both ends 20 of waist strap 14 (only one strap 18 can be seen in FIG. 1) through stitching 22. The other end of strap 18 is connected to buckle 24. The length of strap 18 may be adjusted to accommodate users of various shapes and sizes. Buckle 24 releasably connects harness assembly 10 to the baby carrier via an anchoring assembly permanently affixed to the carrier, as will be described in further detail below.

Figure 2:
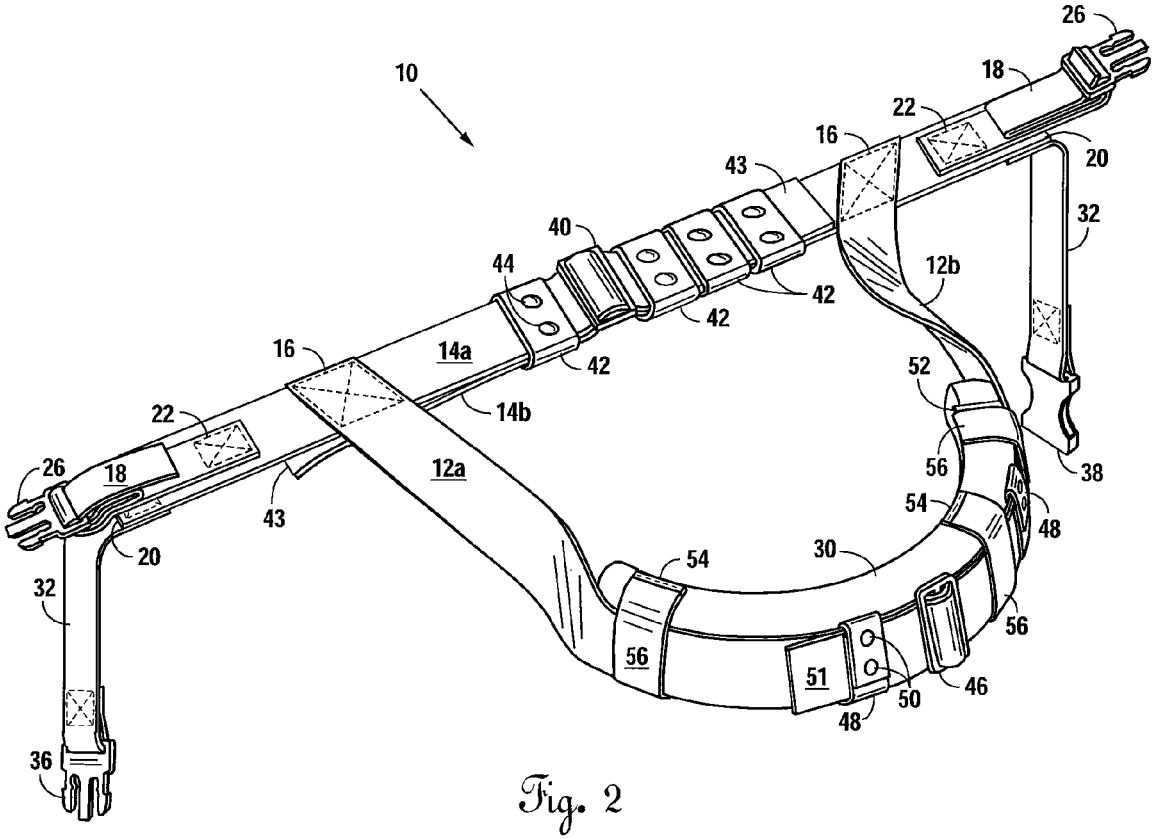
FIG. 2 is a perspective view of the present invention.

Referring now to FIG. 2, waist strap 14 is comprised of first portion 14*a* and second portion 14*b* held together with slide 40. Slide 40 is used to make adjustments to the length of waist strap 14. A plurality of keepers 42 are in slidably removable connection with waist strap 14. Snaps 44 secure keepers 42 to waist strap 14. Keepers 42 prevent ends 43 of waist strap 14 from flapping by keeping ends 43 (and any excess portion thereof) of waist strap 14 securely tied down. Though FIG. 2 shows the use of four keepers on waist strap 14, more or less keepers may be used depending upon the user's preference.

FIG. 2 further illustrates male end 26 of buckle 24 (see FIG. 1) connected to strap 18 at end 20 of waist strap 14. Male end 26 extends distally from strap 18. This is the same at either end 20 of waist strap 14 (i.e., first and second portions 14*a* and 14*b*). Strap 18 may be adjusted to lengthen or shorten the length of strap 18 to accommodate users of various sizes. Securing straps 32 are attached at one end to waist strap 14 via stitching or other comparable fastening means. This is also the same at either end 20 of waist strap 14, i.e., first and second portions 14*a* and 14*b*. In one embodiment, securing straps 32 are attached to the inside of waist strap 14. Male end 36 and female end 38 of buckle 34 (see FIG. 4) are attached to the opposite end of securing straps 32 via stitching or other comparable fastening means. Securing straps 32 may be adjusted to lengthen or shorten the length of securing straps 32 to accommodate users of various sizes.

Still referring to FIG. 2, shoulder strap 12 is comprised of first portion 12*a* and second portion 12*b* that are held together via slide 46. Slide 46 is used to make adjustments to the length of shoulder strap 12. A plurality of keepers 48 are in slidably removable connection with shoulder strap 12. Snaps 50 secure keepers 48 to shoulder strap 12, as shown in FIG. 2. Keepers 48 prevent end 51—only one of which is shown in FIG. 2—(and any excess portion thereof) of shoulder strap 12 from flapping by keeping end 51 of shoulder strap 12 securely tied down. Though FIG. 2 shows the use of two keepers on shoulder strap 12, the user may use more or less keepers depending upon the user's preference. It is also contemplated that keepers may be used where male and female ends 26, 28, respectively (FIGS. 2 and 3), of buckle 24 (FIG. 1) fasten so that the excess strap, e.g., strap 18 (See FIGS. 1 and 2), from buckle 24 can be secured down.

The keepers of the present invention are made of polypropylene webbing material, though other comparable material, such as nylon webbing, may also be used. The buttons are stainless steel. However, other comparable fastening means, such as hook-and-loop material or the like, may be used.

Shoulder strap 12 is reinforced with padding member 30 for additional comfort to the user and also to offset the weight of the carrier and child. Flaps 52 are attached via stitching 54 or other comparable fastening means to either side of padding member 30. Each opposing flap contains corresponding portions of hook-and-loop material (i.e., Velcro) which, when folded over one another, form loop 56 capable of receiving shoulder strap 12 therethrough. The plurality of loops 56 thus maintains padding member 30 securely fastened to shoulder strap 12, as shown in FIG. 2. Padding member 30 can be made of cloth stuffed with 2" foam rubber, the cloth being made up of a soft microbe-free fabric material. Padding member 30 may also have a slip-free material on the surface that will be in contact with the user's shoulder to prevent slippage.

Flaps 52 may be used, not only for securing padding member 30 to shoulder strap 12, but also as an additional way to secure, for example, a diaper bag (not shown) or a purse (not shown) by wrapping each opposing flap containing hook-and-loop material around shoulder strap 12 and the strap for the diaper bag or purse.

In an alternative embodiment, the present invention may also contain one or more pockets or pouches along shoulder strap 12 for carrying of various items, such as a car keys, mobile device, e.g., cellular phone, wireless device, tablet, etc. . . .

Shoulder strap 12 and waist strap 14 are made of water resistant polypropylene webbing material approximately 0.060 inches and have a breaking strength range of 675 to 1800 pounds. The polypropylene webbing material also has a melting point of 330° F. Shoulder strap 12 and waist strap 14 are approximately 3 inches wide. Widths of less than 1½ inches are not recommended due to safety concerns and in order to maintain the strength of the polypropylene webbing material to carry the carrier. Strap 18 and securing strap 32 are approximately 1-1½ inches wide and also made of water resistant polypropylene webbing material. Though the present invention utilizes polypropylene webbing material, other comparable material, such as nylon webbing, may also be used.

Figure 3:
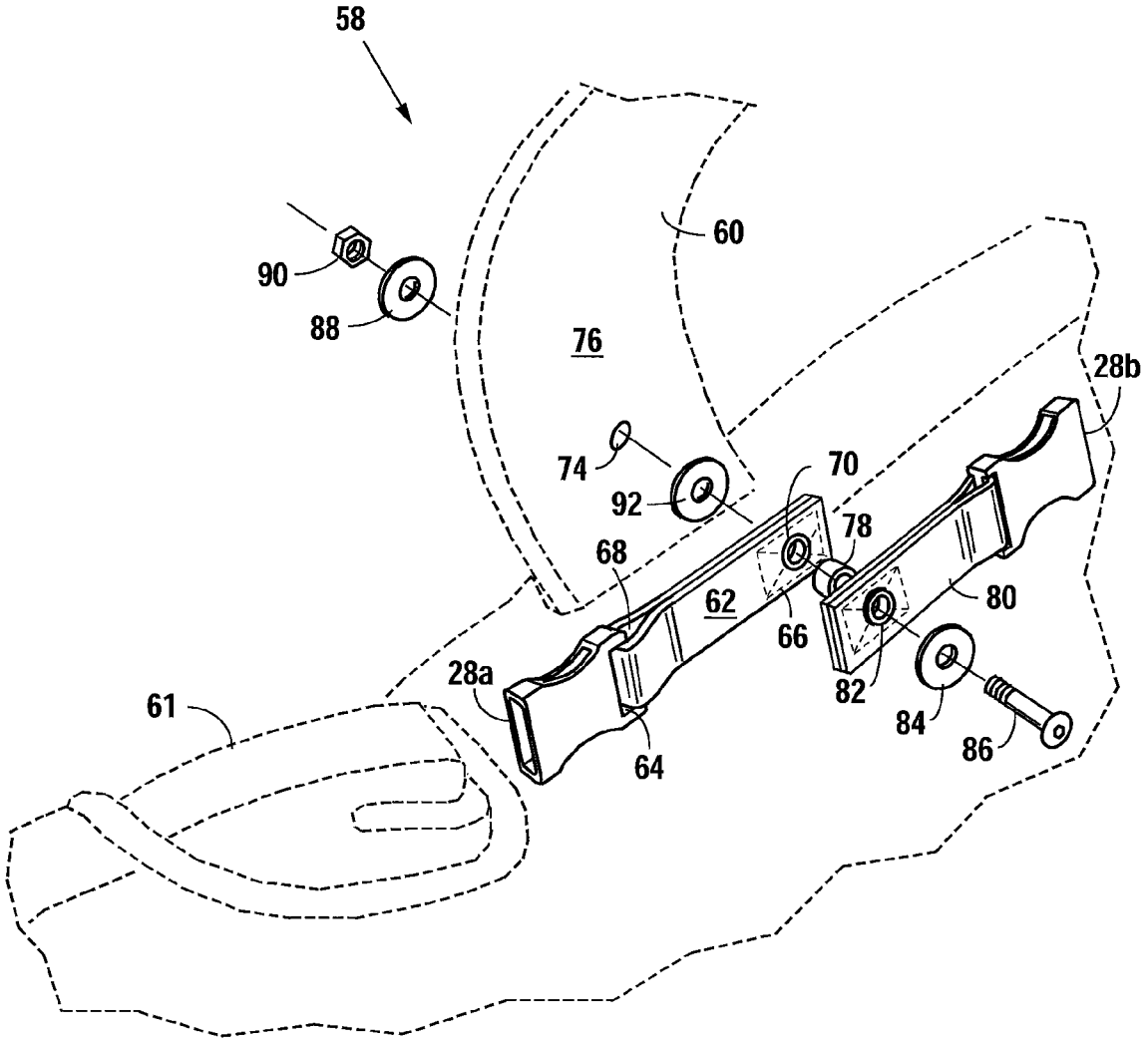
FIG. 3 is an exploded perspective view of the anchoring assembly of the present invention.

Referring now to FIG. 3, the anchoring assembly of the present invention is illustrated. Anchoring assembly 58 is comprised of a plurality of washers, a plurality of anchoring straps, and at least one spacer secured to a carrier bar of a carrier by a fastener and a lock nut. Anchoring assembly 58 is permanently secured at each end of carrier bar 60 and provides the means by which harness assembly 10 is releasably secured to carrier 61.

Aperture 74 is made through carrier bar 60 in close proximity to where carrier bar 60 attaches to carrier 61. Washer 92 is then aligned with aperture 74 on inside surface 76 of carrier bar 60. Anchoring strap 62 is looped through looping end 64 of female end 28*a* of buckle 24 (not shown) and folded in half forming loop 68 such that the two opposite ends of anchoring strap 62 are fastened together via stitching 66. Grommet 70 is incorporated into the opposite ends of anchoring strap 62. Grommet 70 is then aligned with washer 92 and aperture 74. A spacer 78 follows. Anchoring strap 80 has a construction similar to anchoring strap 62, as shown in FIG. 2. Grommet 82 of anchoring strap 80 is aligned after spacer 78 followed by washer 84. Fastener 86 then traverses washer 84, grommet 82, spacer 78, grommet 70, washer 92 and carrier bar 60 (through aperture 74) of carrier 61. Fastener 86 secures washer 84, grommet 82, spacer 78, grommet 70, and washer 92 to carrier bar 60 of carrier 61. Washer 88 and lock nut 90 are threaded onto the end of fastener 86 on the outside surface of carrier bar 60 thereby permanently anchoring anchoring assembly 58 to carrier bar 60.

Fastener 86 permanently attaches anchoring straps 62 and 80 to carrier bar 60 at a fixed location while allowing anchoring straps 62 and 80 with female ends 28*a* and 28*b*, respectively, to rotate freely about the axis along which they are fastened by fastener 86. Anchoring straps 62 and 80 are the dual points of engagement used to secure harness assembly 10 to carrier 61.

Anchoring assembly 58 is permanently anchored at a fixed location to carrier bar 60 on either side of carrier 61. Anchoring assembly 58 utilizes two anchoring straps 62 and 80 on each side of carrier 61, i.e., at both ends of carrier bar 60 in close proximity to where carrier bar 60 attaches to carrier 61. This allows harness assembly 10 to be anchored to either side of carrier 61, depending upon the user's preference, and have carrier bar 60 positioned between the user and carrier 61. In other words, the user may have the carrier hanging at the user's left side or at the user's right side.

The use of the double anchoring straps (62, 80) is a safety feature that reduces or eliminates injury to the child. The double anchoring straps prevent the carrier from flipping toward or away from the user such that the child may fall out and be injured. In addition, the double anchoring straps also prevent the carrier from twisting forward or backward.

This two-point engagement is also a built-in redundancy safety feature that prevents harm to the child in the unlikely event that one anchoring strap fails. The remaining buckle and anchoring strap are of sufficient strength to continue to hold the carrier securely to prevent the child from falling. When utilized, the present invention permits the user's hands to remain free while transporting the infant or child in the carrier.

FIG. 3 illustrates the various individual components that make up the anchoring assembly, as previously described. In an alternative embodiment, however, the anchoring assembly may be included in a single piece. For example, the anchoring assembly may have the components of the anchoring assembly all joined together, e.g., welded, such that the user only need place fastener 86 through the single anchoring assembly to fasten and secure same to carrier bar 60 of carrier 61.

The present invention utilizes ¼"-20×1.75" hex head cap screws as fasteners. However, other kinds of fasteners, such as a bolt or the like, may be used. Spacer 78 is a ¼"×⅜"×½" spacer and may be of nylon, metal or other comparable material. The grommets are ⅜" (ID). Washers 72, 84 and 88 are ¼"×1¼" Fender type flat washers which spread the load. The lock nut is a ¼"-20 nylon lock nut. Washers and spacers are used to allow for extra reinforcement through which the weight of the carrier and the infant can be evenly distributed much more than if anchoring straps 62 and 80 were fastened with just fastener 86 alone.

In carriers where the inside surface 76 of carrier bar 60 is not solid, e.g., contains a latticed or semi-hollowed configuration, an additional spacer (not shown) of appropriate length may be used in connection with a correspondingly larger washer. The additional spacer contemplated is a ⅜"×½"×½" spacer and may be made of nylon, metal or other comparable material and is positioned between inside surface 76 and the correspondingly larger washer. The correspondingly larger washer is a 5/16"×1½" Fender type flat washer which spreads the load and is positioned between the additional spacer and washer 92. The additional spacer and correspondingly larger washer would be used for each side of the carrier where the carrier bar connects to the carrier.

Figure 4:
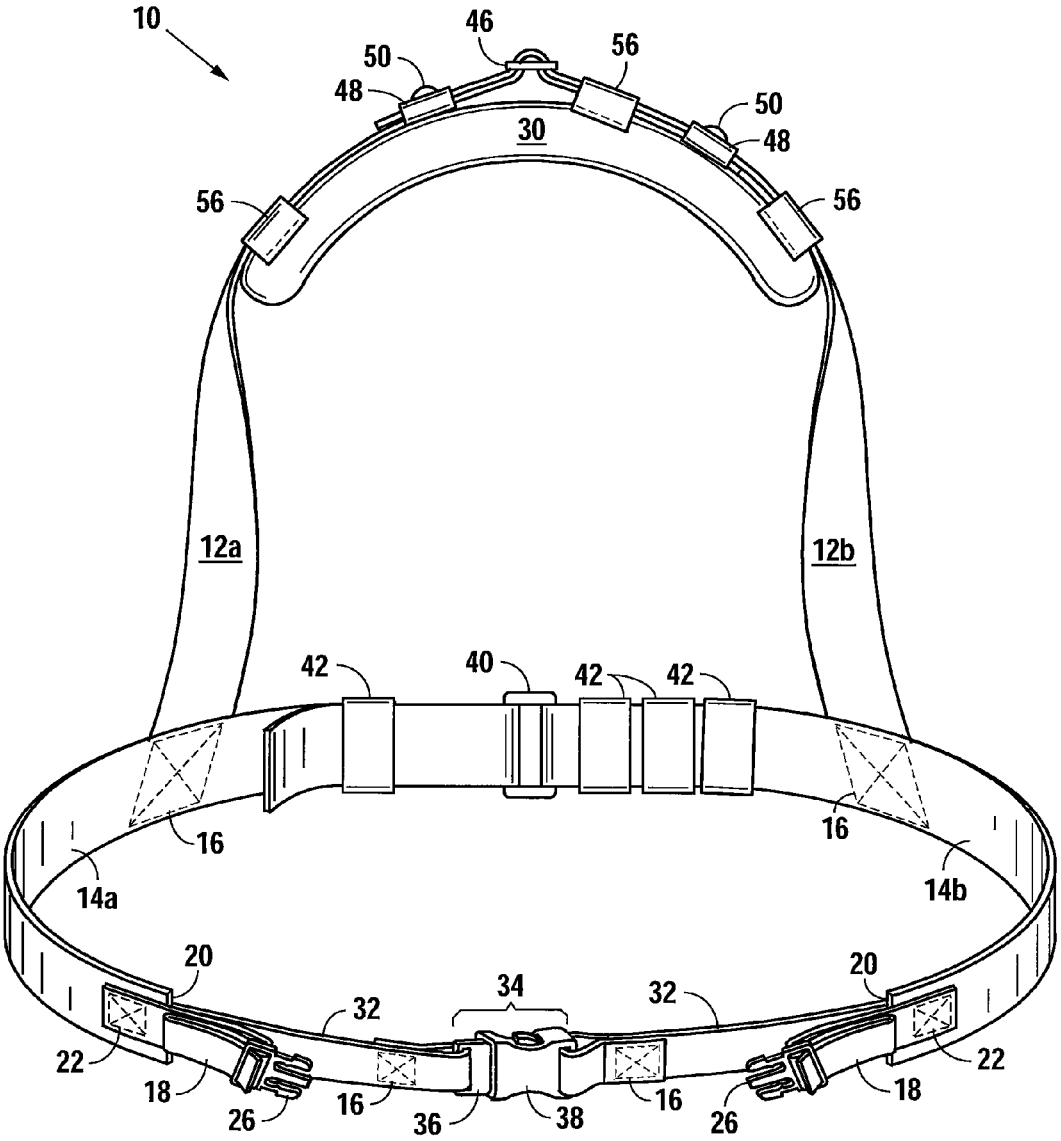
FIG. 4 is a side perspective view of the present invention.

FIG. 4 illustrates harness assembly 10 as harness assembly 10 is worn by a user (not shown) but is not connected to a baby carrier. Securing strap 32 is fastened around the user via buckle 34. This prevents ends 20 of waist strap 14 (i.e., first and second portions 14*a* and 14*b*) from flapping around when harness assembly 10 is not connected to a baby carrier. The length of securing strap 32 may be adjustable to accommodate users of all shapes and sizes.

Referring now back to FIG. 1, to put on harness assembly 10, the user wears harness assembly 10 such that shoulder strap 12 goes over either the user's left or right shoulder depending on the user's preference. Shoulder strap 12 traverses across the user's chest and back toward the waist, adjusting shoulder strap 14 for snugness, comfort and proper fit. Waist strap 14 is aligned around the user's waist. Shoulder straps 12 can be adjusted to adjust the height that carrier 61 will be carried next to the user, preferably at hip level. Similarly, waist straps 14 can be adjusted to adjust the snugness, comfort and proper fit of harness assembly 10 about the waist of the user. Securing strap 32 may also be fastened by coupling together male end 36 and female end 38 of buckle 34 (FIG. 4). The adjustability of the present invention provides for a system that accommodates users of various sizes.

The height as to where the carrier is secured to the user's side is a safety feature of the invention that prevents the carrier from flipping over as the carrier is unable to clear the body of the user. The height at which the carrier rests on the user's hip is important because once the harness is properly adjusted (which is at a particular height specific for each user), the user's arm on the side where the carrier will be resting is truly free to be able to move without the carrier interfering with the arm movement.

To fasten harness assembly 10 to carrier 61, the user secures harness assembly 10 to carrier 61 by engaging male ends 26 (FIG. 2) of buckle 24 of harness assembly 10 to the corresponding female ends 28*a* and 28*b* of anchoring assembly 58 anchored to carrier bar 60 (FIG. 3). Harness assembly 10 is attached directly to carrier bar 60 of carrier 61. Carrier 61, now attached to harness assembly 10 at two points of engagement, is secured to the side of the user opposite the shoulder with shoulder strap 12. The dual engagement points also prevent carrier 61 from twisting, swinging or flipping. Once harness assembly 10 is connected to carrier 61, the user may carry carrier 61 "hands-free."

In use, the user will have the weight of carrier 61 and the baby firmly against his or her left or right hip opposite the shoulder with shoulder strap 12. This configuration optimizes the distribution of weight from carrier 61 and child. The weight is distributed evenly across the chest and shoulders and waist. Waist strap 14 cooperates with shoulder strap 12 to prevent shoulder strap 12 from sliding towards and rising up the user's neck and causing irritation. Waist strap 14 is also of sufficient width to provide adequate back support to the user during use.

An infant being transported in carrier 61 using the present invention will remain in the same orientation as required by law when being transported in a vehicle (i.e., facing backwards). The user's hands are then free to perform other functions, such as carry a diaper bag, open a door, etc.

An advantage of the present invention is that a parent or user is now able to remove an infant or child from the backseat of a vehicle (not shown) without sacrificing safety. In essence, the individual would put on harness assembly 10 making the necessary adjustments across the chest and waist for optimum comfort and fit. The user then secures harness assembly 10 to carrier 61 via anchoring assembly 58, as previously described. Once harness assembly 10 is securely fastened to carrier 61 via anchoring assembly 58, the release lever (not shown) of carrier 61 can be used to disengage carrier 61 from the carrier mount which is fastened in the backseat and, with a single fluid motion, the user can pull carrier 61 out of the vehicle (not shown) and onto the desired hip for further transportation of the child. The child and carrier remain continuously and securely anchored, either to the car seat or the user or both (briefly during transfer), thereby preventing injury from being dropped. To return carrier 61 back to the carrier mount fastened in the backseat of the vehicle, these steps are done in reverse.

The present invention may be retrofitted to existing carrier models and/or incorporated into carriers during the manufacturing process.

The various embodiments described herein may be used singularly or in conjunction with other similar devices. The present disclosure includes preferred or illustrative embodiments of specifically described apparatuses, assemblies, methods and systems. Alternative embodiments of such apparatuses, assemblies, methods and systems can be used in carrying out the invention as claimed and such alternative embodiments are limited only by the claims themselves. Other aspects and advantages of the present invention may be obtained from a study of this disclosure and the drawings, along with the appended claims.

I claim:

1. A harness system for a baby carrier, said system comprising:

a harness assembly; and an anchoring assembly for anchoring to said baby carrier, said anchoring assembly comprising:

a plurality of washers, a plurality of anchoring straps, and at least one spacer for securing to a carrier bar of said carrier by a fastener and a lock nut;

wherein said plurality of anchoring straps has an aperture at one end and a female end buckle at the opposite end, said female end buckle adapted to receive a cooperating male end buckle;

wherein said plurality of anchoring straps are freely rotatable about the axis along which said plurality of anchoring straps are fastened to said carrier bar by said fastener;

wherein said anchoring assembly is for permanently securing to said carrier bar of said carrier;

wherein said plurality of washers, said plurality of anchoring straps, and said at least one spacer are joined together into a single component; and said anchoring assembly releasably connected to said harness assembly at two points of engagement.

* * * * *